US011085210B2

(12) United States Patent
Amagai et al.

(10) Patent No.: US 11,085,210 B2
(45) Date of Patent: Aug. 10, 2021

(54) VEHICLE DOOR STRUCTURE

(71) Applicant: HONDA MOTOR CO., LTD., Tokyo (JP)

(72) Inventors: Toyohisa Amagai, Wako (JP); Suguru Akaki, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 537 days.

(21) Appl. No.: 16/015,378

(22) Filed: Jun. 22, 2018

(65) Prior Publication Data

US 2019/0017297 A1 Jan. 17, 2019

(30) Foreign Application Priority Data

Jul. 12, 2017 (JP) ..... JP2017-136420

(51) Int. Cl.
*E05B 77/04* (2014.01)
*E05B 79/20* (2014.01)

(52) U.S. Cl.
CPC ..... *E05B 77/04* (2013.01); *E05B 79/20* (2013.01)

(58) Field of Classification Search
CPC ..... E05B 77/04; E05B 79/20; E05B 77/10; E05B 77/36; E05B 79/04; E05B 79/06; E05B 83/36; E05B 85/12; B60J 5/0412; B60J 5/0451; B60J 5/0433; B60J 5/0455; B60J 5/0461; B60J 5/0456
See application file for complete search history.

(56) References Cited

U.S. PATENT DOCUMENTS

| | | | | |
|---|---|---|---|---|
| 5,752,346 | A * | 5/1998 | Kritzler | B60J 5/0433 49/502 |
| 6,438,899 | B1 * | 8/2002 | Feder | B60J 5/0416 296/146.7 |
| 6,725,606 | B2 | 4/2004 | Nishikawa et al. | |
| 7,156,448 | B2 * | 1/2007 | Armbruster | B60J 5/0431 296/146.6 |
| 9,365,095 | B2 | 6/2016 | Kajigai et al. | |
| 2018/0291653 | A1 * | 10/2018 | Strigle | E05B 79/20 |

FOREIGN PATENT DOCUMENTS

| | | | |
|---|---|---|---|
| JP | S63-083365 | U | 6/1988 |
| JP | 2001-239833 | A | 9/2001 |
| JP | 2001-303824 | A | 10/2001 |
| JP | 2006-077490 | A | 3/2006 |

(Continued)

OTHER PUBLICATIONS

Japanese Office Action issued for Japanese Patent Application No. 2017-136420 dated Jul. 3, 2020.

(Continued)

*Primary Examiner* — Kristina R Fulton
*Assistant Examiner* — Noah Horowitz
(74) *Attorney, Agent, or Firm* — Thomas | Horstemeyer, LLP

(57) ABSTRACT

A door structure for a vehicle, comprising: a latch connected to a cable portion extending from an inner handle and configured to fix a door to a vehicle body; and a bracket attached to a door inner panel, wherein at least a part of the bracket overlaps the latch in a vehicle width direction and is located toward the outside of the vehicle with respect to the latch.

7 Claims, 5 Drawing Sheets

(56) References Cited

FOREIGN PATENT DOCUMENTS

| | | | |
|---|---|---|---|
| JP | 5909220 | B2 | 4/2016 |
| JP | 2016-088474 | A | 5/2016 |
| KR | 10-2005-0053218 | A | 6/2005 |

OTHER PUBLICATIONS

Japanese Office Action (w/ partial English translation) issued for Japanese Patent Application No. 2017-136420 dated Mar. 22, 2019.
Japanese Office Action issued for Japanese Patent Application No. 2017-136420 dated Nov. 8, 2019.
Canadian Office Action issued for Canadian Patent Application No. 3009789 dated May 8, 2019.

* cited by examiner

VEHICLE DOOR STRUCTURE

BACKGROUND OF THE INVENTION

Field of the Invention

The present invention relates to a vehicle door structure.

Description of the Related Art

Japanese Patent No. 5909220 discloses providing a restricting member that restricts the displacement of the rod of the outer handle of a door main body when an impact load is input from the outside of a vehicle, thereby preventing the door main body from being set in an open state.

However, when an impact load (mainly, a side collision load) is input from the outside of the vehicle, the door inner panel of the door main body moves toward the inside of the vehicle. Along with the movement of the door inner panel, a cable with one end connected to an inner handle is pulled to the vehicle inside. The other end of the cable is connected to a latch mechanism attached to the door inner panel. Along with the movement of the cable, the engagement between the latch mechanism and the vehicle body is canceled. That is, by the impact load, the inner handle is set in a pseudo operation state by the user. Hence, the door main body may open.

The present invention has been made in consideration of the above-described problem, and provides a technique for preventing a door main body from being set in an open state when an impact load is input from the outside of a vehicle.

SUMMARY OF THE INVENTION

In order to solve the above-described problem and achieve the object, there is provided a door structure for a vehicle, comprising: a latch connected to a cable portion extending from an inner handle and configured to fix a door to a vehicle body; and a bracket attached to a door inner panel, wherein at least a part of the bracket overlaps the latch in a vehicle width direction and is located toward the outside of the vehicle with respect to the latch.

DESCRIPTION OF THE EMBODIMENTS

Figure 1:
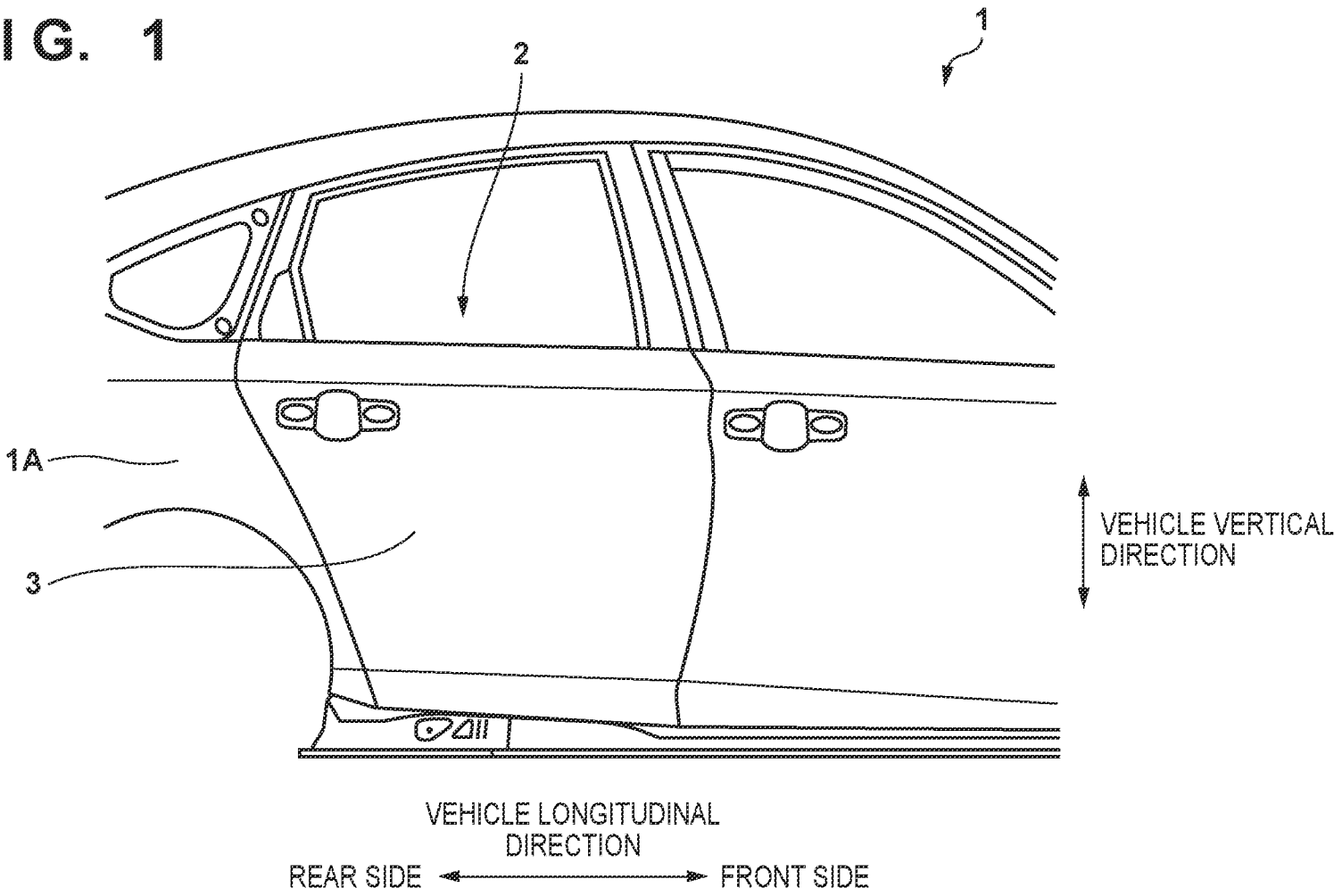
FIG. 1 is a view showing the outer appearance of a door to which a door structure according to an embodiment is applied.

An embodiment of the present invention will now be described with reference to the accompanying drawings. Note that the same reference numerals denote the same constituent elements throughout the drawings.

FIG. 1 is a view showing the outer appearance of a vehicle 1 to which a vehicle door structure according to an embodiment of the present invention is applied. The vehicle 1 according to this embodiment includes a vehicle body 1A and a vehicle door 2. As the vehicle door 2 according to this embodiment, the right rear door (the door of the seat behind the driver seat) of a four-wheeled vehicle is shown. However, the present invention is not limited to this, and can also be applied to the door of the driver seat, the door of the passenger seat, the left rear door, or a sliding door.

Referring to FIG. 1, a vehicle longitudinal direction and a vehicle vertical direction are defined. The left side of the paper surface indicates the vehicle rear side, the right side indicates the vehicle front side, the upper side of the paper surface indicates the vehicle upper side, and the lower side indicates the vehicle lower side. In addition, a direction perpendicular to the paper surface indicates a vehicle width direction (not shown) representing the widthwise direction of the vehicle. The vehicle door 2 includes a door outer panel 3 that forms the exterior of the door, and can be opened/closed with respect to the vehicle body 1A.

Figure 2:
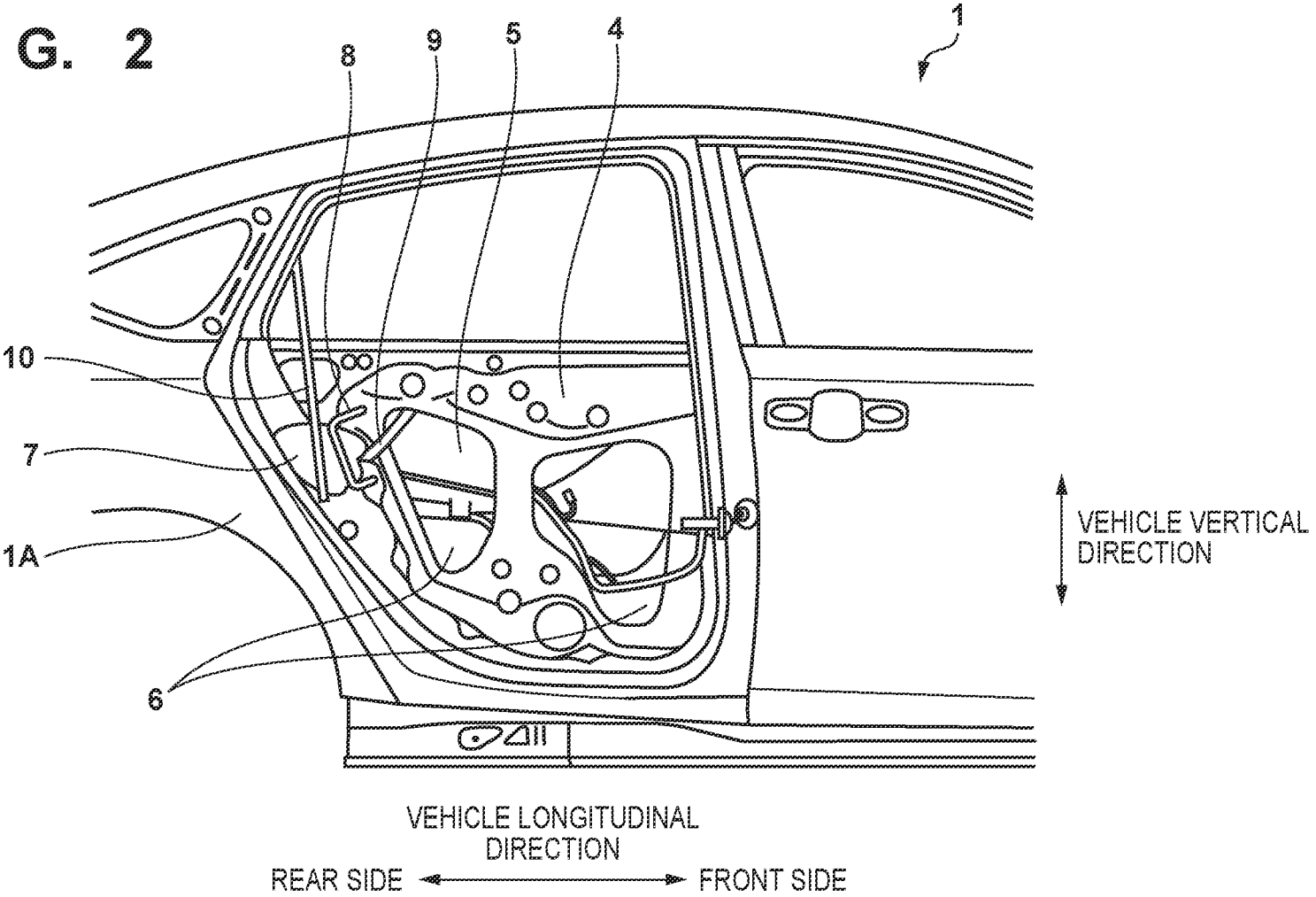
FIG. 2 is a view showing a state in which a door outer panel is removed from the door.
Figure 3:
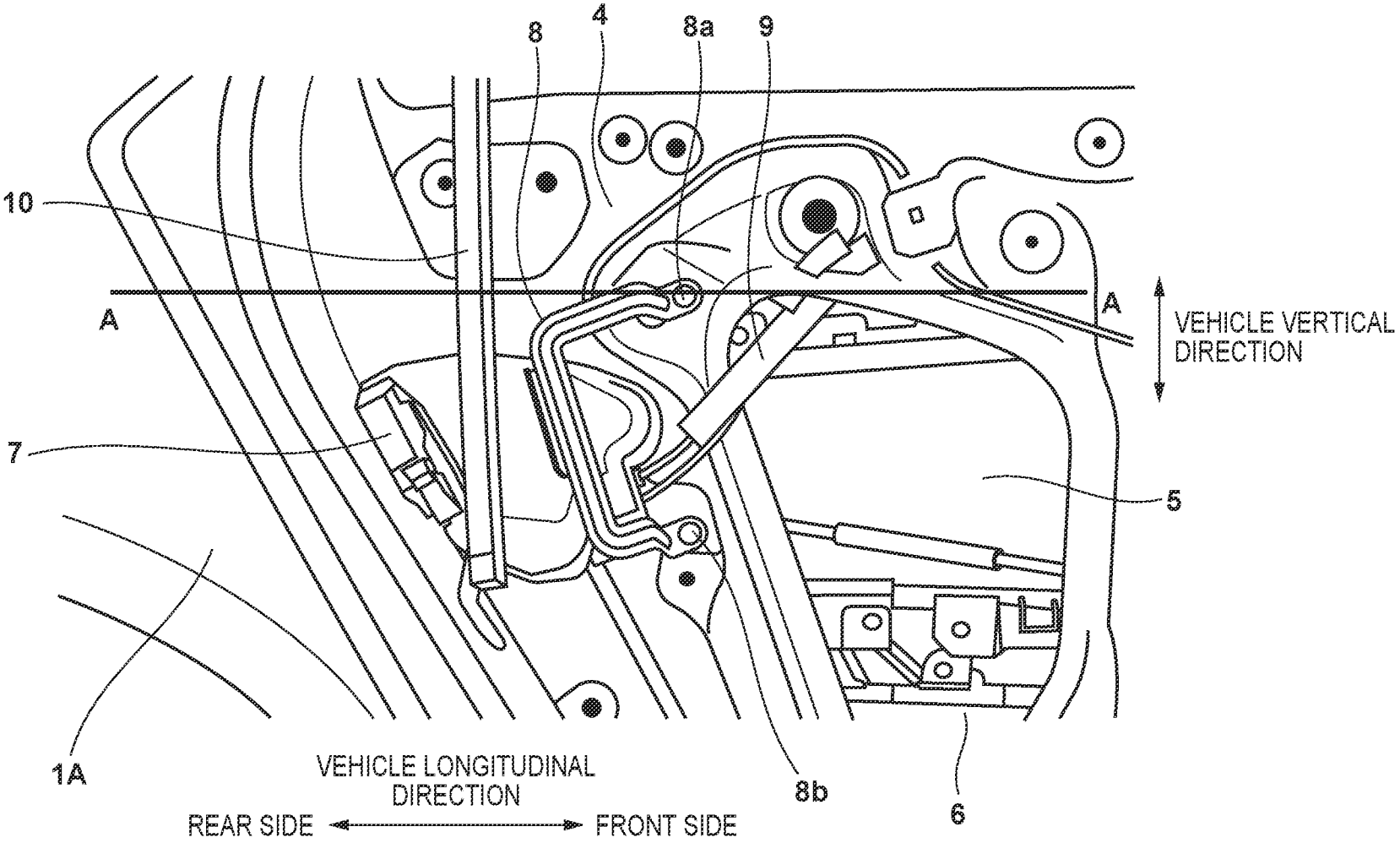
FIG. 3 is a view showing details of the internal structure of the door.
Figure 4:
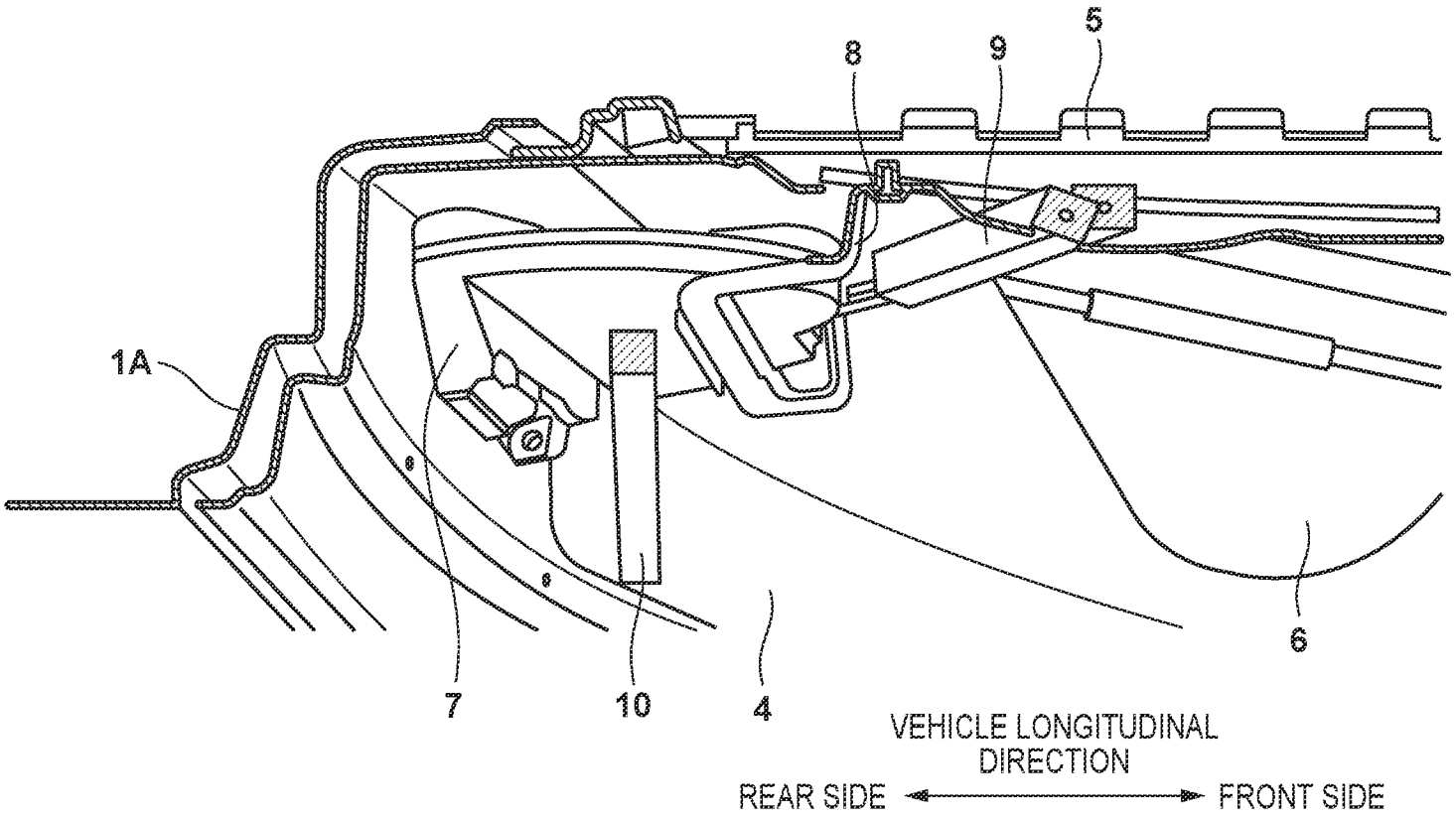
FIG. 4 is a sectional view of the internal structure of the door taken along a line A-A.
Figure 5A:
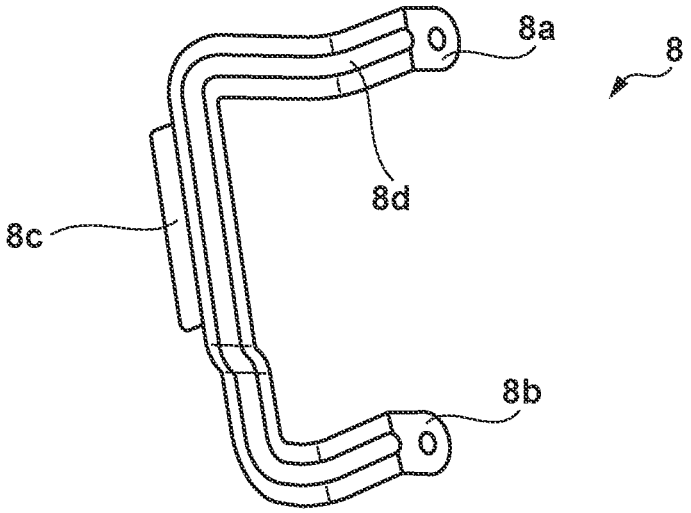
FIGS. 5A and 5B are views showing the outer appearance of a bracket according to the embodiment.
Figure 5B:
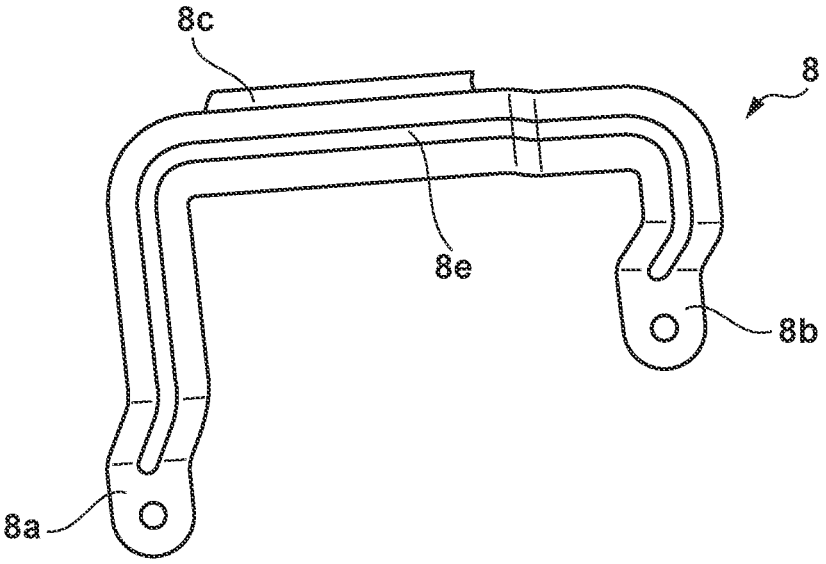

FIG. 2 is a view showing the outer appearance of the vehicle 1 in a state in which the door outer panel 3 is removed. FIG. 3 is a view showing details of the internal structure of the vehicle door 2. FIG. 4 is a sectional view of the internal structure in FIG. 3 taken along a line A-A. FIGS. 5A and 5B are views of the outer appearance of a bracket. The vehicle door 2 includes a door inner panel 4, a cushioning member 5, an inner constituent member 6, a latch 7, a bracket 8, a cable portion 9, and a sash member 10.

The door inner panel 4 is a panel member that constitutes the inside of the door. The cushioning member 5 is a member configured to absorb an impact when an impact load is input from the outside of the vehicle 1 (for example, at the time of a side collision), and is formed by, for example, an elastic member of rubber or the like. The inner constituent member 6 is a member that constitutes the inside of an interior on the periphery of an inner handle used to operate the door from the inside of the vehicle 1. The latch 7 is a mechanism configured to fix the vehicle door 2 to the vehicle body 1A when the vehicle door 2 is closed, and is formed to be able to engage with the vehicle body 1A via the door inner panel 4. The latch 7 is connected to the cable portion 9 extending from the inner handle.

As shown in FIGS. 5A and 5B, the bracket 8 is a metal member including attachment portions 8*a* and 8*b*, a flange portion 8*c*, and bead portions 8*d* and 8*e*, and is attached to the door inner panel 4 via the attachment portions 8*a* and 8*b*. When at least two attachment portions 8*a* and 8*b* are provided, the connection between the bracket and the door inner panel can be further stabilized, as compared to a case in which one attachment portion is used. Note that the present invention can be applied independently of the number of attachment portions. One attachment portion may be provided, or three or more attachment portions may be provided. The bead portions 8*d* and 8*e* are formed by the convex portion 8*d* and the concave portion 8*e*, and provided throughout in the longitudinal direction of the bracket 8. Accordingly, even if a large load is applied to the attachment portions 8*a* and 8*b* of the bracket 8, they can stand the load because the shape rigidity becomes high. Note that the bead portions 8*d* and 8*e* need not always be formed throughout in the longitudinal direction of the bracket 8, and need only be formed at least partially.

The flange portion 8*c* is a second plate member extending from a part of an end face of a first plate member on which the bead portions 8*d* and 8*e* are formed in the longitudinal direction of the bracket 8 toward the projecting direction of the bead portion (convex portion 8*d*). The first plate member and the second plate member are formed to, for example, make a right angle. However, the present invention is not limited to the right angle, and the plate members need only be formed at an angle. As described above, when the flange portion 8*c* is provided, the rigidity of the bracket 8 increases, and the bracket 8 hardly breaks. Note that the flange portion 8*c* is not always necessary, and an arrangement in which the flange portion 8*c* is not provided may be employed.

One end of the cable portion 9 is connected to an inner handle (not shown) used to operate the door from the inside of the vehicle 1, and the other end is connected to the latch 7. In accordance with the operation of the inner handle, the engagement between the latch 7 and the vehicle body 1A is canceled, and the vehicle door 2 can be set in an open state. A cable portion (not shown) extending from an outer handle (not shown) is also connected to the latch 7. In this embodiment, however, the cable portion 9 extending from the inner handle side will mainly be described, and a description of the cable portion on the outer handle side will be omitted.

The sash member 10 is a metal member extending upward in the vehicle vertical direction from the door inner panel 4 toward a window portion.

In this embodiment, at least a part (for example, a portion including the flange portion 8*c*) of the bracket 8 overlaps the latch 7 in the vehicle width direction and is located toward the outside of the vehicle with respect to the latch 7. Accordingly, when an impact load is input from the outside of the vehicle, the bracket 8 comes into contact with the latch 7, and the latch 7 functions as a prop. It is therefore possible to prevent the cable portion 9 from being pulled and prevent the door from being set in an open state.

Additionally, as show in FIG. 4, the bracket 8 and the latch 7 do not abut. Hence, alignment between the members in a door assembling process is facilitated, and additionally, generation of contact noise caused by a vibration of the vehicle body can be suppressed. When an impact load is input from the outside of the vehicle, the door inner panel 4 is pressed to the vehicle inside, and accordingly, the bracket 8 attached to the door inner panel 4 is pulled to the vehicle inside. The bracket 8 and the latch 7 thus abut. By this abutment, the latch 7 fixed to the vehicle body 1A functions as a prop. It is therefore possible to, at the time of impact load input from a vehicle side, obtain an effect of suppressing pushing of the door inner panel 4 to the vehicle inside and prevent the cable portion 9 extending from the inner handle from being pulled.

Furthermore, the at least two attachment portions 8*a* and 8*b* are configured to be located on the front side of the latch 7 in the vehicle longitudinal direction. Since this enables prop to a point on the door inner panel 4 on the front side of the latch 7 in the vehicle longitudinal direction, pressing of the door inner panel 4 can be further suppressed. It is therefore possible to, at the time of impact load input from a vehicle side, more effectively prevent the cable portion 9 from being pulled and prevent the door from being set in an open state.

Additionally, as shown in FIG. 4, the at least two attachment portions 8*a* and 8*b* are located on the vehicle inside of the latch 7 in the vehicle width direction, and the distance between the inner handle (not shown) and the at least two attachment portions 8*a* and 8*b* is shorter than the distance between the latch 7 and the inner handle (not shown). That is, the inner handle, the attachment portions 8*a* and 8*b*, and the latch 7 are sequentially arranged from the inside to the outside in the vehicle width direction. Since this enables prop to a point on the door inner panel 4 close to the inner handle at the time of impact load input from a vehicle side, it is possible to more effectively prevent the cable portion 9 from being pulled.

Note that the above-described embodiment is an example as a means of the present invention, and the present invention is applicable to a correction or modification of the embodiment without departing from the scope of the present invention. The door structure according to this embodiment can be applied to any vehicle other than an automobile, as a matter of course.

Summary of Embodiment

1. A door structure according to the above embodiment is a door structure for a vehicle, comprising:

a latch (for example, 7) connected to a cable portion (for example, 9) extending from an inner handle and configured to fix a door (for example, 2) to a vehicle body (for example, 1A); and a bracket (for example, 8) attached to a door inner panel (for example, 4), wherein at least a part of the bracket overlaps the latch in a vehicle width direction and is located toward the outside of the vehicle with respect to the latch.

According to this embodiment, when an impact load is input from the outside of the vehicle, the bracket comes into contact with the latch, and the latch functions as a prop. It is therefore possible to prevent the cable portion from being pulled and prevent the door from being set in an open state.

2. In the door structure according to the above embodiment, the bracket (for example, 8) and the latch (for example, 7) do not abut.

According to this embodiment, alignment between members in a door assembling process is facilitated, and additionally, generation of contact noise caused by a vibration of the vehicle body can be suppressed.

3. In the door structure according to the above embodiment, the bracket (for example, 8) is attached to the door inner panel (for example, 4) via at least two attachment portions (for example, 8*a*, 8*b*) of the bracket.

According to this embodiment, the connection between the bracket and the door inner panel can be further stabilized, as compared to a case in which one attachment portion is used.

4. In the door structure according to the above embodiment, the at least two attachment portions (for example, 8*a*, 8*b*) are located on a front side of the latch in a vehicle longitudinal direction.

According to this embodiment, since this enables prop to a point on the door inner panel on the front side of the latch in the vehicle longitudinal direction, it is possible to more effectively prevent the cable portion from being pulled and prevent the door from being set in an open state.

5. In the door structure according to the above embodiment, the at least two attachment portions (for example, 8*a*, 8*b*) are located on a vehicle inside of the latch (for example, 7) in the vehicle width direction, and a distance between the inner handle and the at least two attachment portions is shorter than a distance between the latch and the inner handle.

According to this embodiment, since this enables prop to a point on the door inner panel close to the inner handle, it is possible to more effectively prevent the cable portion from being pulled and prevent the door from being set in an open state.

6. In the door structure according to the above embodiment, the bracket (for example, 8) includes a bead portion (for example, 8*d*, 8*e*).

According to this embodiment, even if a large load is applied to the attachment portions (for example, 8*a*, 8*b*) of the bracket, they can stand the load because the shape rigidity becomes high.

7. In the door structure according to the above embodiment, the bracket (for example, 8) includes a flange portion (for example, 8*c*).

According to this embodiment, the rigidity of the bracket increases, and the bracket hardly breaks.

According to the present invention, it is possible to prevent a door main body from being set in an open state when an impact load is input from the outside of a vehicle.

This application claims the benefit of Japanese Patent Application No. 2017-136420, filed Jul. 12, 2017, which is hereby incorporated by reference herein in its entirety.

What is claimed is:

1. A door structure comprising:

a latch connected to a cable portion extending from an inner handle and configured to fix a door to a vehicle body; and a metal bracket attached to a door inner panel, wherein the bracket includes a first portion that extends in a vehicle vertical direction, a second portion that extends from one end of the first portion toward a vehicle front and comprises an attachment portion at its tip, and a third portion that extends from another end of the first portion toward a vehicle front and comprises an attachment portion at its tip, wherein the bracket is attached to the door inner panel via at least two attachment portions, wherein the first portion, the second portion and the third portion of the bracket are constituted to have a substantially U-shaped side view, wherein at least a part of the first portion overlaps the latch in a vehicle width direction and is located toward an exterior of the vehicle body relative to the latch.

2. The structure according to claim 1, wherein the bracket and the latch do not abut.

3. The structure according to claim 1, wherein the at least two attachment portions are located on a front side of the latch in a vehicle longitudinal direction.

4. The structure according to claim 1, wherein the at least two attachment portions are located on a vehicle inside of the latch in the vehicle width direction, and a distance between the inner handle and the at least two attachment portions is shorter than a distance between the latch and the inner handle.

5. The structure according to claim 1, wherein the bracket includes a bead portion.

6. The structure according to claim 1, wherein the bracket includes a flange portion.

7. The structure according to claim 1, wherein the second portion of the bracket includes a fourth portion that is connected to the attachment portion and extends toward an exterior of the vehicle body of the vehicle width direction, and wherein the third portion of the bracket includes a fifth portion that is connected to the attachment portion and extends toward an exterior of the vehicle body of the vehicle width direction.

* * * * *